United States Patent [19]

Pepe et al.

[11] 4,304,062

[45] Dec. 8, 1981

[54] LOADING TOOL FOR CARTRIDGE MAGAZINE

[75] Inventors: Edward R. Pepe, Kensington, Conn.; Henry J. Tatro, Westfield, Mass.

[73] Assignee: Chandler Evans Inc., West Hartford, Conn.

[21] Appl. No.: 141,630

[22] Filed: Apr. 18, 1980

[51] Int. Cl.[3] ..... F42B 39/06

[52] U.S. Cl. ..... 42/87

[58] Field of Search ..... 42/87, 90, 1 R

[56] References Cited

U.S. PATENT DOCUMENTS 2,403,012 7/1946 McPheters ..... 42/87

2,451,521 10/1948 Uglum ..... 42/87

*Primary Examiner*—Charles T. Jordan

*Attorney, Agent, or Firm*—Radford W. Luther; Richard A. Dornon

[57] ABSTRACT

A loading tool for a cartridge magazine embodies a channel for positioning a cartridge to be inserted in the magazine and a rear wall inclined at a preselected angle for orientating the feed mouth of the magazine over the cartridge at the proper angle and relative position such that vertical movement of the magazine causes the rear portion of the cartridge to enter the cartridge opening of the feed mouth. Longitudinal guide surfaces, disposed on either side of the channel and extending from the rear wall, respectively engage the slider lips of the magazine for terminating downward travel of the magazine and guiding subsequent forward movement of the magazine to permit complete insertion of the cartridge.

3 Claims, 5 Drawing Figures

LOADING TOOL FOR CARTRIDGE MAGAZINE

BACKGROUND OF THE INVENTION

This invention relates to devices for loading the cartridge magazines of firearms.

Various devices and methods are available for filling cartridge magazines. For example, many cartridge magazines can be filled with cartridges from relatively complicated stripper clip arrangements or magazine chargers. A cartridge magazine can, of course, be filled in the traditional way by utilizing one's finger to insert one cartridge after another which can become tedious if a number of magazines must be loaded.

SUMMARY OF THE INVENTION

The invention provides a simple loading tool for a cartridge magazine which embodies no moving parts. The loading tool of the invention is specially shaped whereby loading of the magazine may be occasioned by merely placing a cartridge in the tool and subsequently manually moving the magazine downwardly and then forwardly. The loading tool is configured to guide the aforementioned motions of the magazine to facilitate proper insertion of the cartridge therein.

Accordingly, it is a primary object of the invention to provide a simple loading tool for a cartridge magazine which enables a cartridge to be quickly and easily inserted in the magazine.

This and other objects and advantages of the invention will become more readily apparent from the following detailed description when taken in conjunction with the accompanying drawings, in which:

DETAILED DESCRIPTION OF PREFERRED EMBODIMENT

Figure 1:
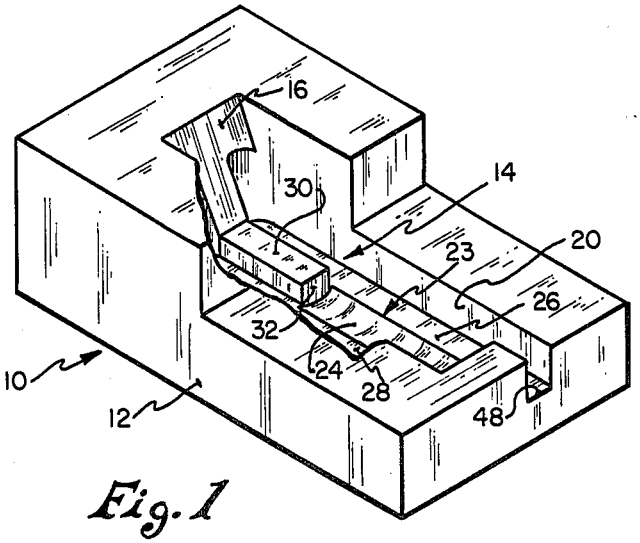
FIG. 1 is a perspective view of a cartridge magazine loading tool according to the invention.

In FIGS. 1 and 3–5 there is shown a loading tool 10 of the invention adapted to facilitate the loading of a conventional cartridge magazine. The illustrated tool has been machined from a billet of metal, although it would preferably be cast or stamped. The tool is constituted by an L-shaped block structure 12 having a recess 14 slightly wider (e.g., 1/32 of an inch) than the magazine which the tool is intended to service.

The periphery of the recess is basically defined by a sloping or inclined rear wall 16, a vertical forward wall 18 (FIG. 4) vertical side walls 20 and 22 and a base generally shown at 23. The base 23 includes a cartridge receiving channel 24 bounded on either side by longitudinal guide surfaces 26 and 28 which extend from the rear wall to the front wall.

The base 23 is also provided with a rib 30 which longitudinally extends from the rear wall 16 to the rear end of the channel so as to provide a vertical extension of the surface formed by the end of the channel and thereby define an abutment surface 32 of adequate height to prevent rearward movement of a cartridge placed in the channel. The distance L between the abutment surface 32 and the front wall 18 is preferably slightly greater (e.g., 1/64 of an inch) than the length of a cartridge whereby the cartridge can be easily placed in the loading tool in a reasonably precise location.

Figure 4:
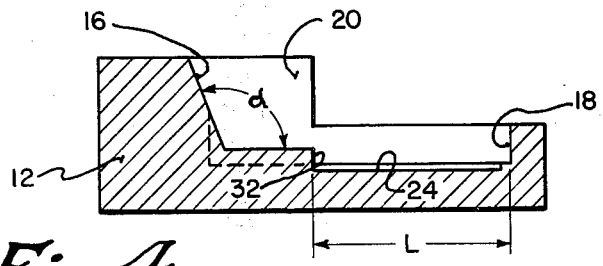
FIGS. 4 and 5 are sectional views of the loading tool taken substantially along the lines 4—4 and 5—5 of FIG. 3, respectively.
Figure 5:
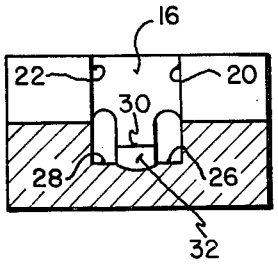

As shown in FIG. 4, the rear wall 16 forms an angle $\alpha$ with the horizontal. The selection of this angle in the usual case would be dependent upon the particular geometry of the cartridge magazine, viz.: the angle defined between the axis of a shell in the mouth of the magazine and the back surface of the magazine. Since it wouuld normally be desirable to have the axis of a shell in the mouth of the magazine somewhat horizontal when it enters the loading tool, the previously defined angle would typically be chosen. It will, of course, be understood that other angles could be selected if mandated by the magazine construction or other factors. It will be further appreciated that the rear wall 16 is spaced a distance sufficient from the abutment surface 32 to insure proper entry of the rear of a cartridge placed in the channel 24 into the cartridge opening of the mouth of the magazine when the back side of the magazine engages the rear wall 16.

Figure 2:
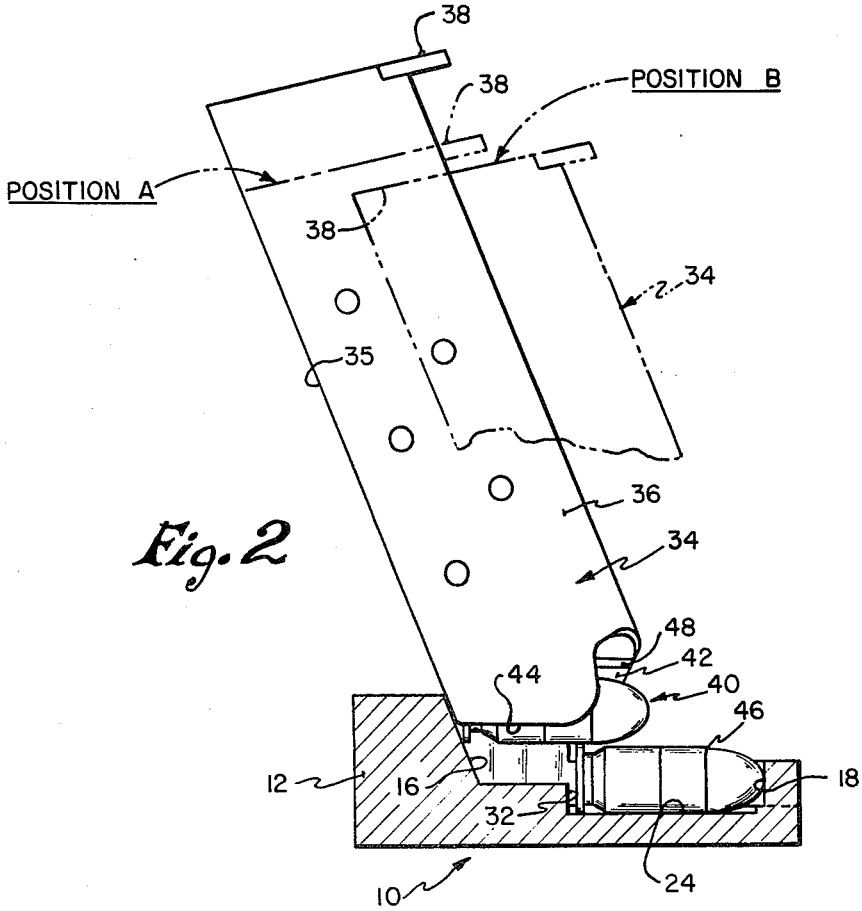
FIG. 2 is a sectional side elevational view of the loading tool of FIG. 1 with a cartridge magazine positioned in the tool awaiting the loading operation.
Figure 3:
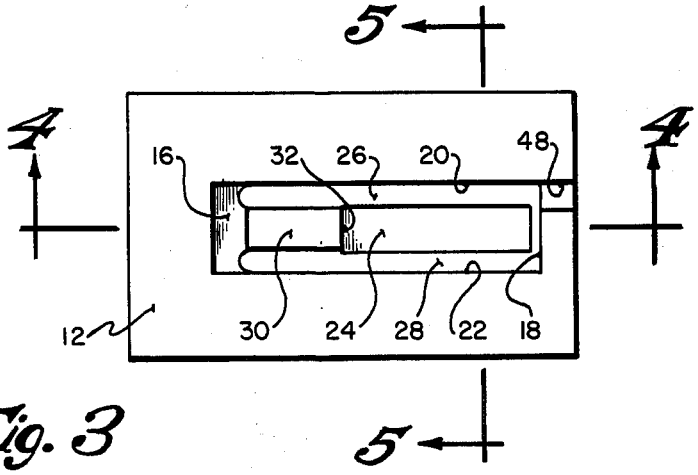
FIG. 3 is a top plan view of the magazine loading tool.

The manner in which the loading tool of the invention is utilized may best be appreciated by reference to FIG. 2. As depicted in FIG. 2, a cartridge magazine 34 of conventional construction has just commenced entering the recess 14 with its back side 35 in sliding engagement with the rear wall 16. The magazine illustrated is that of the well-known 1911 Colt .45 semi-automatic pistol and embodies the usual tube 36 having a floor plate 38 and mouth 40. Mouth 40 is defined by a cartridge opening 42 and a pair of slider lips 44. The magazine is adapted to contain a row of cartridges 46 urged toward the lips 44 by a spring loaded follower 48 such that the top-most cartridge abuts the lips 44.

Further downward movement of the magazine 34 to the position (designated A) in which the lips 44 respectively engage the guide surfaces 26 and 28 causes the rear of the cartridge in the channel 24 to push the front portion of the cartridge in the mouth 40 further into the magazine, thereby displacing the follower and adjacent cartridge and compressing the follower spring (not shown). This latter action results in the rear portion of the cartridge in the channel 24 being received into the cartridge opening 42 of the mouth 40 whereby full insertion thereof may be readily effectuated by a subsequent forward movement of the magazine 34.

Forward movement of the magazine 34 from the position A to a forward-most position (designated B) results in the lips 44 sliding over the guide surfaces 26 and 28 and, ultimately, the complete insertion of the cartridge resting in the channel into the mouth 40 of the magazine 34. The contact between the nose of the cartridge in the channel and the front wall 18 serves to fixedly position the cartridge during this forward movement. As in the usual manual loading operation, the inserted cartridge slidingly engages the adjacent cartridge. In position B, the magazine 34 can no longer be moved forwardly because the now top-most cartridge is fully inserted and its nose is in firm contact with the front wall 18. The magazine 34 may now be removed from the recess 14 and a new cartridge placed in the channel.

It should be noted that if the particular form of magazine embodies a flange or other surface which could be damaged by repeated contacts with the front wall 18, relief cuts such as illustrated at 48 may be provided. However, such relief cuts are not mandated for the particular magazine illustrated.

Obviously many modifications and variations are possible in light of the above teachings without departing from the scope and spirit of the invention as defined in the subjoined claims.

We claim:

1. A loading tool for a cartridge magazine comprising a structure having a recess therein, the recess being defined by:

a sloping rear wall inclined at an angle approximating the angle at which the magazine should enter the recess for optimum cartridge insertion;

two vertical side walls spaced apart a distance slightly greater than the width of the magazine such that entry of the magazine into the recess and subsequent movements therein are guided;

a front wall adapted to engage the nose of a cartridge to prevent forward movement thereof as it is being inserted in the magazine; and a base having: a longitudinally extending channel disposed in a central portion of the base for receiving a cartridge to be loaded into the magazine; an abutment surface for engaging the rear of the cartridge positioned adjacent the end of the channel, the abutment surface being spaced from the front wall a distance slightly greater than the length of a cartridge for facilitating placement of the cartridge in the channel; and two longitudinally extending guide surfaces disposed on either side of the channel over which the lips of the magazine are adapted to slide during insertion of a cartridge in the mouth of the magazine.

2. A loading tool, as defined in claim 1, wherein the abutment surface is at least partially defined by a rib which extends longitudinally from the rear wall.

3. A loading tool, as defined in claim 2, wherein the structure is L-shaped such that the front portion of the recess is of a lesser depth than the rear portion of the recess to permit easy cartridge placement in the channel and removal of the magazine after insertion of a cartridge therein.

* * * * *

UNITED STATES PATENT AND TRADEMARK OFFICE

CERTIFICATE OF CORRECTION

PATENT NO. : 4,304,062

DATED : December 8, 1981

INVENTOR(S) : Edward R. Pepe and Henry J. Tatro

It is certified that error appears in the above-identified patent and that said Letters Patent are hereby corrected as shown below:

On the title page:

Change the assignee from "Chandler Evans Inc." to --Colt Industries Operating Corp--

Signed and Sealed this

*Twenty-eighth* Day of *June 1983*

[SEAL]

*Attest:*

GERALD J. MOSSINGHOFF

*Attesting Officer*

*Commissioner of Patents and Trademarks*